US005954062A

United States Patent [19]

Murata

[11] Patent Number: 5,954,062

[45] Date of Patent: Sep. 21, 1999

[54] ARTIFICIAL HAIR AND A BUNDLE OF FIBERS USING THE SAME FOR HEAD DECORATIVE ARTICLES

[75] Inventor: Shoichi Murata, Takasago, Japan

[73] Assignee: Kaneka Corporation, Osaka, Japan

[21] Appl. No.: 09/195,994

[22] Filed: Nov. 20, 1998

[30] Foreign Application Priority Data

| | | | |
|---|---|---|---|
| Nov. 21, 1997 | [JP] | Japan | 9-321379 |
| Nov. 27, 1997 | [JP] | Japan | 9-325858 |
| Oct. 28, 1998 | [JP] | Japan | 10-307129 |

[51] Int. Cl.[6] ..... A41G 3/00

[52] U.S. Cl. ..... 132/53; 132/201; 260/836; 525/420

[58] Field of Search ..... 132/53, 54, 201; 57/242, 902; 428/364, 373; 264/185, 85, 205, 210.8; 525/420; 260/836

[56] References Cited

U.S. PATENT DOCUMENTS

| | | | |
|---|---|---|---|
| 3,786,822 | 1/1974 | Kimura et al. | 132/53 |
| 3,826,298 | 7/1974 | Tanaka et al. | 152/359 |
| 3,910,291 | 10/1975 | Kim | 132/53 |
| 4,603,083 | 7/1986 | Tanaka et al. | 428/364 |
| 4,698,194 | 10/1987 | Tanaka et al. | 264/185 |
| 4,767,827 | 8/1988 | Iwatsuki et al. | 525/420 |
| 4,793,131 | 12/1988 | Mizuno et al. | 57/243 |
| 5,204,041 | 4/1993 | Tashiro et al. | 264/210.8 |

*Primary Examiner*—Gene Mancene
*Assistant Examiner*—Pedro Philogene
*Attorney, Agent, or Firm*—Armstrong, Westerman, Hattori, McLeland & Naughton

[57] ABSTRACT

The present invention relates to artificial hair comprising polyvinyl alcohol fibers with a shrinkage percentage of 10% or less under a dry heat condition at 18° C., preferably a shrinkage percentage of 10% or less under a dry heat condition at 20° C. and with a fineness in the range of 25 to 100 denier wherein the ratio (S)/(L) of the length of short axis (S)/the length of long axis (L) in the sectional shape is in the range of 0.75 to 1. The artificial hair of the invention can be curled in a wide temperature range under hair iron setting conditions for human hair without deteriorating commodity qualities and without using special curl setting temperature conditions such as for conventional artificial hair consisting of synthetic fiber.

7 Claims, 1 Drawing Sheet

ARTIFICIAL HAIR AND A BUNDLE OF FIBERS USING THE SAME FOR HEAD DECORATIVE ARTICLES

BACKGROUND OF THE INVENTION

1. Field of the Invention

The present invention relates to novel artificial hair used for head decorative articles such as wigs, hair accessories etc. and a bundle of fibers using the same for head decorative articles.

2. Description of the Prior Art

At present, the majority of head decorative articles such as wigs, hair accessories etc. are produced from hair materials such as human hair, yak's hair, or artificial hair made of synthetic fibers, and generally these are curled for use. Curl setting in this case is divided roughly into 2 methods depending on the type and the object of hair materials. One method is the so-called cold permanent setting method by chemicals to fix hair materials in an arbitrary curled shape, and the other method is the heat setting method where hair materials are curled under heating with a heat source for dry heating or wet heating and their shape is fixed by cooling. The cold permanent setting method is a method applied to head decorative articles made of keratinous fibers such as proteinous fibers including human hair and yak's hair, while the heat setting method can be applied not only to head decorative articles made of the proteinous fibers described above but also to head decorative articles made of artificial hair consisting of synthetic fibers.

In the heat setting method described above, the temperature conditions for setting vary depending on the type of the starting materials, and the majority of head decorative articles made of artificial hair consisting of synthetic fibers is thermally set at a temperature in the range of about 70 to 160° C., and in this temperature range, articles made of polyvinyl chloride fibers are thermally set at low temperatures, articles made of polyester fibers are thermally set at high temperatures, and articles made of a large number of other synthetic fibers such as acrylic fibers, polypropylene fibers etc. are thermally set at intermediate temperatures in many cases. If artificial hair made of these synthetic fibers is thermally set at temperatures exceeding the upper limit of these appropriate temperatures, curling due to fiber shrinkage occurs and commodity values are lost. Accordingly, in heat setting of artificial hair consisting of synthetic fibers, the temperature conditions for setting should be controlled carefully. On the other hand, the temperature range for heat setting of human hair as a typical example of proteinous fibers is wider than that of the artificial hair consisting of synthetic fibers described above, and heat setting is conducted usually at 100 to 200° C., and the control of the temperature conditions for setting does not require high accuracy. However, human hair when thermally set has the character of tight or loose curls depending on the temperature for setting, so human hair is set generally at higher temperatures than for the artificial hair consisting of synthetic fibers in order to confer durability on curls.

From the foregoing reasons, in cases where the artificial hair consisting of synthetic fibers thermally set at relatively low temperatures, and proteinous fibers thermally set at relatively high temperatures, are mixed for use, heat setting at lower temperatures results in poor durability of curls because of the poor setting force of the proteinous fibers particularly natural keratinous fibers, whereas heat setting at higher temperatures leads to curling due to shrinkage of the artificial hair consisting of synthetic fibers, thus worsening the appearance of the product to reduce commodity values. Accordingly, the proteinous fibers such as human hair etc. and the artificial hair consisting of synthetic fibers are rarely mixed for use, and these are used separately in many cases to produce head decorative articles.

On the other hand, from the viewpoint of articles, head decorative articles such as wigs, hair accessories etc. particularly for weaving, are subjected to curl setting after attached to the head, and thus heat setting with hair irons is frequently used. Among hair irons, a temperature-controllable iron with a cord is cumbersome to handle, so a stove-type hair iron is used in many cases. The heat source of this stove-type hair iron is a stove, and heat setting in this case utilizes the heat remaining in the hair iron heated in a stove, and after removed from the stove, the temperature of the hair iron drops significantly, so the temperature of the stove should be maintained at high temperatures. Accordingly, the control of the temperature of the hair iron at the time of setting is readily made approximate. As a result, if artificial hair consisting of usual synthetic fibers is used in articles for such use, the synthetic fibers when subjected to heat setting by a hair iron are curled due to shrinkage by the high-temperature hair iron to worsen the appearance of the resulting article. Accordingly, under the present circumstances, the starting materials of head decorative articles like a weaving to be thermally set by a hair iron are limited substantially to natural keratinous fibers such as human hair etc.

However, a supply of natural keratinous fibers such as human hair etc. is limited, and their qualities have been worsened year by year to make their fiber length short, their prices are increasing, and these fibers become difficult to obtain. For example, wigs or hair accessories consisting exclusively of natural keratinous fibers with a hair length exceeding than 16 to 18 inches are becoming expensive for the consumer, so there is demand for a method of obtaining them inexpensively.

To meet the demand, polypropylene fibers, polyvinyl chloride fibers, or polyvinyl alcohol (PVA) fibers with higher thermostability than acrylic fibers would be used as starting materials being capable of setting at high temperatures with a hair iron and being mixed with natural keratinous fibers, but at present, there are no examples in which these synthetic fibers are applied to head decorative articles such as wigs, hair accessories etc. As technology relating to hair materials composed of PVA, e.g. Japanese Patent Laid-Open Patent Publication No. 47263/1991 discloses artificial hair consisting of synthetic fibers prepared by spinning a spinning stock solution consisting of a mixture of PVA and chitosan. In this prior art, the mixture is utilized to improve the water resistance and thermostability of the artificial hair, and it is described that if the solid content of chitosan by weight is less than 5 (that is, the solid content of PVA exceeds 95), water resistance, thermostability, gloss etc. cannot be satisfied, and that if particularly high water resistance is required, water resistance can be improved without adding any cross-linking agent by conducting heating treatment for a prolonged period of time until the fibers turn dark brown. In this case, however, use of expensive chitosan in an amount exceeding the predetermined content and discoloration into dark brown by heating treatment, as described above, are problematic. Further, Japanese Patent Publication Nos. 2775/1970 and 30033/1968 disclose artificial hair using fibers prepared by spinning a spinning stock solution composed of artificial hair materials and PVA, and the improvement of setting properties is referred to as one of the objects therein, but it is described that the section of the resulting fiber is an irregular unsymmetrical section, and the effect of improving setting properties is not clarified. In any of the three inventions described above, artificial hair resembling human hair is obtained by spinning a spinning stock solution consisting of PVA and other polymer components, and it not attempted to improve the thermostability of artificial hair using PVA polymer alone.

A large number of PVA fibers produced at present are generally as thin as 8 denier or less, and usually PVA fibers can be obtained by spinning an aqueous solution of PVA into a solidification solution that is an aqueous solution of conc. Glauber's salt to form fibers, followed by drying, stretching and heating treatment. However, the PVA fibers obtained in this method are cocoon- or horseshoe-shaped in section, and spinning of fibers with 25 denier or more in this method involves slow solidification and difficult production. PVA fibers with a circular section can be produced by spinning an aqueous solution of PVA into a coagulation bath of an aqueous solution of conc. caustic soda or by spinning an aqueous solution of PVA containing a small amount of boric acid into a coagulation bath that is an aqueous alkaline solution of conc. Glauber's salt. Under the present circumstances, however, among fibers obtained in this method, those with a thickness of 25 to 100 denier applicable as artificial hair do not have thermostability so that the fibers cannot be thermally set in the range of 160 to 200° C. used for human hair.

BRIEF SUMMARY OF THE INVENTION

The object of the present invention is to provide novel artificial hair which can be thermally set under the same conditions as for proteinous fibers such as human hair and which can be mixed and used with such proteinous fibers, as well as a bundle of fibers using the same for head decorative articles.

To achieve the above object, the present inventors focused their attention on shrinkage at a temperature for heat setting of various synthetic fibers considered as the starting materials of artificial hair, and they examined and analyzed heat setting properties by a hair iron under the same setting conditions for human hair. As a result, the present inventors found that it is important to specify fineness required for heat shrinkage characteristics and hair characteristics, more preferably the sectional shape of the fiber in order to produce artificial hair that can be thermally set without deteriorating the qualities of head decorative articles, and the present invention was thereby completed. That is, the present invention relates to artificial hair comprising PVA fibers with a shrinkage percentage of 10% or less under a dry heat condition at 180° C., more preferably a shrinkage of 10% or less at 200° C., and with a fineness in the range of 25 to 100 denier.

The shrinkage percentage under a dry heat condition is a value determined by heat-treatment of a bundle of fibers at a predetermined temperature of 180 or 200° C. for 30 minutes in a loose form, then cooling it to room temperature, measuring the sample length $L_D$ (mm), and determining the shrinkage degree relative to the sample length L (mm) before heat treatment according to the following equation:

$$\text{Shrinkage percentage under a dry heat condition } (\%) = 100 \times (L - L_D)/200$$

The ratio (S/L) of the length of short axis (S)/the length of long axis (L) in the sectional shape of the PVA fiber is preferably in the range of 0.75 to 1. The ratio (S/L) of the length of short axis (S) and the length of long axis (L) in the sectional shape of the PVA fiber refers to the ratio (S/L) where the long axis (L) has the longest sectional width among straight lines passing over the median point G in the fiber section and the short axis (S) has the continuous maximum fiber sectional width perpendicular to the long axis (L) and passing over the center of the long axis, as shown in FIG. 1.

The artificial hair according to the present invention described above is obtained preferably by spinning an aqueous solution of PVA containing boric acid into an aqueous solution of alkaline inorganic salt, subjecting the resulting fibers to acetalation and dry heating treatment at a temperature of 180° C. or more, preferably in the range of 200 to 240° C. so that shrinkage percentage of the fibers under a dry heat condition at 180° C. becomes 10% or less, and their average fineness becomes 25 to 100 denier.

The artificial hair according to the present invention described above can be used alone to produce head decorative articles, but 90 to 10 parts by weight of the artificial hair may be mixed with 10 to 90 parts by weight of proteinous fibers to produce a bundle of fibers for head decorative articles. As the proteinous fibers, natural keratinous fibers such as human hair, yak's hair etc. are more preferable.

Figure 1:
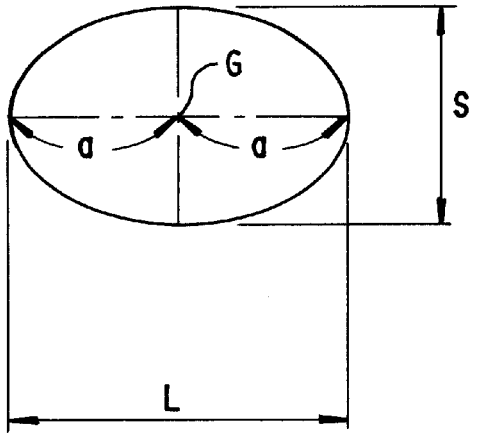
FIG. 1 is a schematic drawing of a fiber section for explaining the ratio in length of the short axis and the long axis in the fiber section.
Figure 2A:
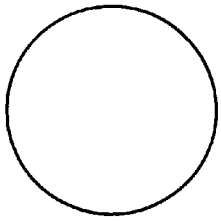
FIGS. 2(*a*) to (*d*) is schematic drawings of fiber sections.
Figure 2B:
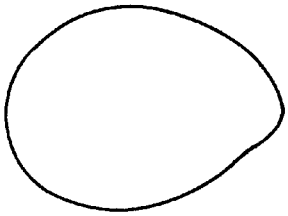
Figure 2C:
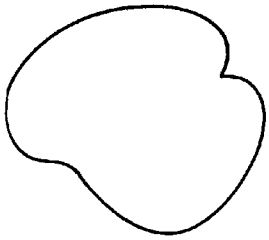
Figure 2D:
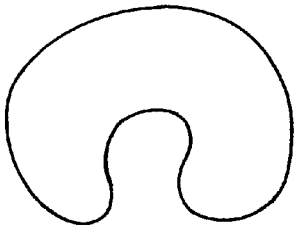

The meanings of the symbols are as follows:

G: median point of the fiber section;

L: length of the long axis;

S: length of the short axis; and a: equally divided distance of the long axis.

DETAILED DESCRIPTION OF THE EMBODIMENT

Hereinafter, the present invention is described in detail. In the artificial hair of the present invention, the degree of polymerization of PVA resin as the starting material is 1000 or more, preferably 1500 or more, and the degree of saponification thereof is 97% or more, preferably 98.5% or more, and such PVA resin can be obtained by forming fibers by wet spinning. If the degree of polymerization of the PVA resin is less than 1000, the effect of post-treatment for improvement of thermostability becomes weak, or fiber physical properties are deteriorated. If the degree of saponification of the PVA resin is less than 97%, significant coloration or fusion among fibers due to post-treatment for improvement of thermostability occurs, so its uses are limited.

The sectional shape of the PVA fiber used in the artificial hair of the present invention is not particularly limited, but in consideration of cosmetic properties of curling characteristics and comb smoothness as artificial hair, a flattened sectional shape with a flatness exceeding 1/10 or with a slightly curved flattened shape tends to be inferior in curl retention properties and is not preferable. Preferable sectional shapes include horseshoe-shaped, C-shaped, hollow type, ellipse-shaped, circular, and dumbbell-shaped, and for example, the sectional shapes shown in FIGS. 2(*a*) to (*d*) can be exemplified. In preferable sectional shapes, the ratio (S/L) in length of short axis (S)/long axis (L) in the sectional shape is in the range of 0.75 to 1, and more preferably the number of concaves on the surface of fiber is 2 or less, more particularly 1 or less per section. If the ratio (S/L) of short axis (S)/long axis (L) in the sectional shape is outside of said range, the tension in curled hair becomes weak, the characteristics of curled hair are deteriorated, and comb smoothness tends to decrease. Said concaves on the surface of fiber are concaves which can be observed at about 30-fold magnification under an optical microscope and exclude those which cannot be observed at further higher magnification. The number of concaves is the number of concaves per section assuming that one concave is an independent region defined by both the outer periphery of the section and a tangent line not penetrating through the fiber section and being in contact at 2 or more points with the outer periphery of the fiber section.

The method of obtaining the fiber with the ratio (S/L) in length of short axis/long axis in the sectional shape ranging from 0.75 to 1 is preferably a method in which a spinning stock solution consisting of an aqueous solution of PVA containing boric acid is spun via a spinning nozzle with a round orifice into a coagulation bath consisting of an aqueous solution of alkaline inorganic salt. The amount of boric acid added to the spinning stock solution is 0.3 to 3% by weight, preferably 0.5 to 2% by weight, relative to PVA. With a smaller amount of boric acid given, the ratio (S/L) in length of the short axis/long axis of the sectional shape of the resulting fiber tends to be less than 0.75, whereas with a too much amount given, the stretching properties of the fiber at the time of subsequent dry heating stretching treatment and the characteristics of the fiber thereafter are adversely affected. As far as the object of the present invention is satisfied, a stabilizer, a coloring agent consisting of a pigment or a dyestuff, a flame-retardant etc. can naturally be added to the spinning stock solution to modify the properties of the fiber for the purpose of light exposure properties, thermostability, and coloration prevention. The coagulation bath should be alkaline and is preferably an aqueous solution of alkaline inorganic salt at pH 10 or more, preferably pH 13 or more, and the aqueous solution of inorganic salt includes an aqueous solution of sodium hydroxide, an aqueous solution of sodium sulfate etc., among which an aqueous solution of sodium sulfate is preferable. Hereinafter, an example using an aqueous solution of sodium sulfate is described. The concentration of sodium sulfate in the coagulation bath ranges from 25% by weight to the concentration of saturation, and is preferably 28% by weight or more. If the concentration of sodium sulfate in the coagulation bath is 25% by weight or less, a large amount of an alkali agent is necessary. PVA coagulated in the form of fibers in the coagulation bath is then subjected to de-alkali treatment in an acidic Glauber's salt bath and then stretched 2- to 7-fold in an aqueous solution of acidic sodium sulfate at 70° C. or more. In this case, acidification of the aqueous solution bath of sodium sulfate needs sulfuric acid as a component in the stretching bath, and the pH is adjusted preferably to 2 or less. Then, the fibers are subjected to wet heating treatment in the aqueous solution bath of sodium sulfate at 70° C. or more, preferably 85° C. or more, and then washed sufficiently with water. Thereafter, the fibers may be dried and stretched as necessary under dry heating. Then, the resulting PVA fibers were subjected to acetalation treatment and heating treatment at a temperature of 180° C. or more, and each of these treatments should conducted one or more times, and the order of these treatments is not limited. Usually, the acetalation treatment of the fibers is conducted preferably by immersing them in an aqueous solution of sodium sulfate containing formaldehyde. The heating treatment is conducted at a temperature of 180° C. or more, preferably at a temperature in the range of 200 to 240° C. for about 10 to 60 minutes. If acetalation is first conducted, it is preferable that the fibers are then washed with water and subjected to usual drying treatment at 100° C. or more to remove water completely, followed by heating treatment. To prevent fusion among fibers in the resulting PVA fibers, it is preferable that a softener or a silicone lubricant for fibers, preferably an amino-modified silicone lubricant is applied to the fibers before drying treatment etc.

The fineness of PVA fibers as the starting material of the artificial hair of the present invention is preferably 25 to 100 denier in average, more preferably 30 to 80 denier. Given 25 denier or less, the artificial hair is too thin in appearance and too soft, whereas given 100 denier or more, it is too thick and too rigid, so in both the cases, the resulting PVA fibers are not suitable as the starting material of the artificial hair. The shrinkage percentage of PVA fibers under a dry heat condition is 10% or less, preferably 7% or less at 180° C., more preferably 10% or less at 200° C. The artificial hair with a shrinkage percentage of 10% or more under a dry heat condition at 180° C. will be shrunk at high temperatures used for setting human hair by a hair iron, thus fastening the hair iron tight to make removal of the hair iron difficult.

EXAMPLES

Hereinafter, the examples of the present invention are described. Measurements were obtained in the following measurement methods.

Fineness

An autobibro-type fineness measuring instrument "DENIER COMPUTER" type DC-11 (Search K. K.) was used for measurement.

Shrinkage Percentage Under a Dry Heat Condtion

A bundle of fibers whose fineness was adjusted to 3000 denier in total was marked with an onomat fiber every 200 mm effective sample length with a load of 10 mg per denier to prepare a sample. This sample was thermally treated by using a convection oven at a predetermined temperature (180° C. or 200° C.) in a loose form for 30 minutes and the sample was removed and cooled to room temperature, and the effective sample length $L_D$ (mm) with a 10 mg load per denier was determined, and the shrinkage degree was determined according to the following equation:

$$\text{Shrinkage percentage under a dry heat condition (\%)} = 100 \times (200 - L_D)/200$$

Example 1

PVA with an average degree of polymerization of 1700 and a degree of saponification of 98.5 mole-% was washed 5 times with cold water at 10° C. or less at the bath ratio of 1:5, then completely dissolved by heating at 90 to 100° C., and further stirred and defoamed under reduced pressure to give a spinning stock solution containing 18.8% by weight of PVA. This stock solution was extruded via 50 spinning nozzles with a pore diameter of 0.60 mm with a round orifice shape, into a solidification bath at 50° C. consisting of an aqueous solution containing 28% by weight of sodium sulfate, 4% by weight of magnesium sulfate, and 0.06% by weight of boric acid and adjusted to pH 4.2 with sulfuric acid, then wound at a take-up rate of 4.4 m/min., and stretched 4-fold in an aqueous solution at 50° C. containing 28% by weight of sodium sulfate, 4% by weight of magnesium sulfate, and 0.06% by weight of boric acid, and air-dried at room temperature in a stretched form. The fibers were further dried by heating at 100° C. for 60 minutes and then subjected to heating treatment at 210° C. for 30 minutes. Then, the fibers were treated in an acetalation bath (bath ratio, 1:100) at 70° C. consisting of 19% by weight of sulfuric acid, 19% by weight of sodium sulfate, and 4.7% by weight of formaldehyde for 90 minutes, and washed sufficiently with water. A surface treatment agent having amino-modified silicone with an amine equivalent of 1700 and a dynamic viscosity of 330 centistoke (cSt) was emulsified with a nonionic surface active agent and applied in an amount of 0.05% by weight of silicon to the fibers, and the fibers were then dried at 80° C. for 1 hour in a stretched form. The resulting PVA fibers were C-shaped in section (sectional shape shown in FIG. 1(*d*)), had a fineness of 50 denier and a heat dry shrinkage degree of 7.0% at 180° C. Then, the fibers were cut into those with an uniform length of 10 inches and subjected to hackling to give a fiber bundle having a fineness of about 30000 denier in total which was then wound spirally on a stove-type hair iron of ¾ inch in diameter to such an extent that the fiber bundle did not overlap, and the fibers were curled for 10 seconds on the hair iron heated at 180° C. The resulting fiber bundle achieved almost the same curl diameter of 20 mm as the diameter of the hair Iron, and there was no shrinkage or curling due to heating. Further, the same hair iron was used for curl setting at 130° C. to yield a curl diameter of 22 mm which was slightly larger than the diameter of the hair iron.

Comparative Example 1

PVA fibers were obtained under the same conditions as in Example 1 except that the heating treatment before acetalation treatment was conducted for 5 minutes at 210° C. This fiber were C-type in sectional shape similar to that in Example 1 and had a fineness of 48 denier and a shrinkage percentage of 16% under a dry heat condition at 180° C. The fibers were used to prepare a fiber bundle and set by a hair iron, and as a result, setting at 130° C. gave the same curl diameter of 22 mm as in Example 1, while setting at 180° C. caused shrinkage and curling of the PVA fibers to make the curl irregular in appearance, and the fibers mixed with human hair were not practical for iron setting in the range of high temperatures suitable for heat setting of human hair.

Example 2

Water-soluble polyvinyl alcohol fibers (Solvron® MH675D/15F, a product of K. K. Nichibi) were thermally treated at 210° C. for 20 minutes in a convection oven and treated in an acetalation bath (bath ratio, 1:100) at 70° C. consisting of 19% by weight of sulfuric acid, 19% by weight of sodium sulfate, and 4.7% by weight of formaldehyde for 90 minutes and then washed sufficiently with water. A surface treatment agent having amino-modified silicone with an amine equivalent of 1700 and a dynamic viscosity of 330 cSt was emulsified with a nonionic surface active agent and applied in an amount of 0.1% by weight of silicon to the fibers, and the fibers were then dried at 80° C. for 1 hour in a stretched form. The resulting PVA fibers had an indeterminate form in section (sectional shape shown in FIG. 1(*b*)), had a fineness of 50.7 denier and a heat dry shrinkage degree of 3.0% at 180° C. and a heat dry shrinkage degree of 3.5% at 200° C. Then, the fibers were cut into those with an uniform length of 10 inches similarly to Example 1, and 40 parts by weight of the resulting fibers were mixed with 60 parts by weight of human hair with an average length of 10 inches and subjected to hackling to give a fiber bundle with a fineness of about 30000 denier in total, which was then wound spirally on a stove-type hair iron of ¾ inch in diameter to such an extent that the fiber bundle did not overlap, and the fibers were curled for 10 seconds on the hair iron heated at 180° C. The resulting fiber bundle, similarly to Example 1, achieved almost the same curl diameter of 20 mm as the diameter of the hair iron, and there was neither difference in curl among the fibers nor shrinkage or curling due to heating. The same hair iron was used for curl setting at 130° C. to yield a large curl diameter of about 25 mm, but there did not appear any difference in the diameter of curl between human hair and the PVA fibers, neither was there shrinkage nor curling, and the curl was tight. Further, curl setting of the fiber bundle for 10 seconds on the hair iron with a surface temperature of 200° C. gave curls with almost the same diameter as the diameter of the hair iron, indicating that the fibers adhered tightly to the hair iron, and there was neither shrinkage nor curling of the fibers as is the case with curl setting at 180° C.

Comparative Example 2

KL-S (KANEKA CORPORATION) mainly consisting of modacrylic fibers as commercial wig filaments was mixed with the same weight of human hair having an average length of 10 inch and subjected to hackling to give a fiber bundle having a fineness of about 30000 denier in total which was then subjected to a hair iron setting. Setting at 120° C. resulted in a set diameter of 20 mm which was slightly larger than the diameter of the hair iron, but setting at 180° C. caused significant shrinkage and curling of the modacrylic fibers, thus making the curl irregular in appearance, and this product was completely inferior as a commodity, and these fibers mixed with human hair were not practical for iron setting in the range of high temperatures suitable for heat setting of human hair. The modacrylic fibers were extremely curled (shrinkage degree, 60%) after subjected to dry heating treatment at 180° C. for 30 minutes.

Example 3

The PVA fibers prepared in Example 1 were cut into those with an uniform length of 10 inches, then mixed with the same weight of human hair with an average length of 10 inches, and subjected to hackling to give a fiber bundle with a fineness of about 30000 denier in total which was then wound spirally on a stove-type hair iron of ¾ inch in diameter to such an extent that the fiber bundle did not overlap, and the fibers were curled for 10 seconds on the hair iron heated at 180° C. The resulting fiber bundle achieved almost the same curl diameter of 20 mm as the diameter of the hair iron, and there did not appear any difference in the shape of curl among the fiber materials, neither was there shrinkage nor curling due to heating. The same hair iron was used for curl setting at 130° C. to yield a large curl diameter of about 25 mm, but there did not appear any difference in the diameter of curl between human hair and the PVA fibers, neither was there shrinkage nor curling, and the curl was tight.

Comparative Example 3

The PVA fibers prepared in Comparative Example 1 were mixed with human hair in the same manner as in Example 3 to prepare a bundle of fibers and set by a hair iron. As a result, setting at 130° C. gave the same curl diameter of 25 mm as in Example 3, while setting at 180° C. caused shrinkage and curling of the PVA fibers to make the curl irregular in appearance and this fiber bundle was not practical for iron setting in the range of high temperatures suitable for heat setting of human hair.

Example 4

To PVA washed with cold water in Example 1 there was added boric acid in an amount of 1% by weight relative to the weight of PVA, and a spinning stock solution with 19.5% by weight of PVA was prepared in the same manner as in Example 1. This stock solution was extruded via 50 spinning nozzles with a pore diameter of 0.3 mm with a round orifice shape, into a solidification bath at 40° C. of an aqueous solution of saturated sodium sulfate adjusted to pH 14 with sodium hydroxide, then wound at a take-up rate of 4 m/min., subjected to de-alkali treatment with a bath at 30° C. of an aqueous solution of acidic sodium sulfate containing 28% by weight of sodium sulfate and adjusted to pH 1 with sulfuric acid, stretched 4-fold in an aqueous solution of acidic sodium sulfate at 855° C. with the same composition as in the above bath, and washed with water. The resulting fibers were air-dried at room temperature in a stretched form and further dried by heating at 100° C. for 60 minutes. Then, the fibers were subjected to heating treatment at 210° C. for 15 minutes and further at 230° C. for 10 minutes, then treated in an acetalation bath (bath ratio, 1:100) at 70° C. consisting of 19% by weight of sulfuric acid, 19% by weight of sodium sulfate, and 4.7% by weight of formaldehyde for 90 minutes, and washed sufficiently with water. A surface treatment agent having amino-modified silicone with an amine equivalent of 1700 and a dynamic viscosity of 330 cSt was emulsified with a nonionic surface active agent and applied in an amount of 0.05% by weight of silicon to the fibers, and the fibers were then dried at 80° C. for 1 hour in a stretched form. After further subjected to heating treatment at 230° C. for 15 minutes, the PVA fibers had a fineness of 32.5 denier and a heat dry shrinkage degree of 7.5%after dry heating at 180° C. for 30 minutes. The section of the fiber was approximately circular with no concave on the surface (e.g. the sectional shape shown in FIG. 2(*a*)) having a short/long axis ratio (S/L) of 0.95. Then, the fibers were cut into those with an uniform length of 10 inches and subjected to hackling to give a fiber bundle having a fineness of about 30000 denier in total which was then wound spirally on a stove-type hair iron of ¾ inch in diameter to such an extent that the fiber bundle did not overlap, and the fibers were curled for 10 seconds on the hair iron heated at 180° C. The resulting fiber bundle achieved almost the same curl diameter of 20 mm as the diameter of the hair iron, and there was no shrinkage or curling due to heating. Further, the same hair iron was used for curl setting at 130° C. to yield a curl diameter of 22 mm which was slightly larger than the diameter of the hair iron.

The hair materials in the Examples and the Comparative Examples and their curl diameters after curl setting are collectively shown in Table 1 below.

TABLE 1

| | Artificial Hair | | | | | Curl diameter (mm) | | | |
|---|---|---|---|---|---|---|---|---|---|
| | Materials | Shrinkage percentage under a dry heat condition at 180° C. (%) | Sectional shape of fiber | Fineness (d) | Mixing ratio of human hair (weight-%) | 120° C. | 130° C. | 180° C. | 200° C. |
| Example 1 | PVA | 7.0 | C-shaped | 50 | 0 | — | 22 | 20 | — |
| Example 2 | PVA | 3.0 | Indeterminate shape | 50.7 | 60 | — | 25 | 20 | 20 |
| Example 3 | PVA | 7.0 | C-shaped | 50 | 50 | — | 25 | 20 | — |
| Example 4 | PVA | 7.5 | Circular with a short/long axis ratio of 0.95 | 32.5 | 0 | — | 22 | 20 | — |
| Comparative Example 1 | PVA | 16 | C-shaped | 48 | 0 | — | 22 | curled | — |
| Comparative Example 2 | Modacrylic fiber | 60 | horseshoe-shaped | 50 | 50 | 22 | 22 | curled | — |
| Comparative Example 3 | PVA | 16 | C-shaped | 48 | 50 | — | 25 | curled | — |

Head decorative articles using the artificial hair of the present invention, such as wigs and hair accessories, particularly for weaving of being attached to user's hair, can be curled on user's hair under the same hair-iron temperature conditions as for human hair and without deteriorating the appearance of hair. Further, a bundle of fibers consisting of the artificial hair mixed with human hair is that being capable of reproducing hair iron properties accurately, being uniform and excellent in the durability to maintain curl, owing to the heat setting properties of the artificial hair of the invention. This bundle of fibers achieves both the natural appearance of human hair which is not uniform resulting from irregular gloss and thickness and the uniform appearance of the artificial hair of the present invention, so it is suitable as the starting material of head decorative articles. Accordingly, the amount of natural keratinous fibers such as human hair etc. whose supply is limited can be reduced using the artificial hair of the invention in head decorative articles, thus providing them inexpensively and stably.

I claim:

1. Artificial hair comprising polyvinyl alcohol fibers with a shrinkage percentage of 10% or less under a dry heat condition at 180° C. and with a fineness in the range of 25 to 100 denier.

2. Artificial hair according to claim 1 wherein the shrinkage percentage of said fiber under a dry heat condition at 200° C. is 10% or less.

3. Artificial hair according to claim 1 wherein the ratio (S)/(L) of the length of short axis (S)/the length of long axis (L) in the sectional shape of said fiber is in the range of 0.75 to 1.

4. Artificial hair according to claim 1 wherein fibers obtained by spinning an aqueous solution of polyvinyl alcohol containing boric acid into an aqueous solution of alkaline inorganic salt are subjected to acetalation and dry heating treatment at a temperature of 180° C. or more to give fibers with a shrinkage percentage of 10% or less under a dry heat condition at 180° C. and with a fineness in the range of 25 to 100 denier.

5. Artificial hair according to claim 4 wherein the temperature of the dry heating treatment is in the range of 200 to 240° C.

6. A bundle of fibers for head decorative articles, comprising 90 to 10 parts by weight of the artificial hair of claim 1 and 10 to 90 parts by weight of proteinous fibers.

7. A bundle of fibers for head decorative articles according to claim 6 wherein the proteinous fibers are keratinous fibers.

* * * * *